United States Patent [19]

Schaefer et al.

[11] Patent Number: 4,557,505

[45] Date of Patent: Dec. 10, 1985

[54] STRESS-OPACIFYING TAMPER INDICATING TAPE

[75] Inventors: Richard M. Schaefer, Bloomington; James J. Tome, Cottage Grove, both of Minn.

[73] Assignee: Minnesota Mining and Manufacturing Company, St. Paul, Minn.

[21] Appl. No.: 568,490

[22] Filed: Jan. 5, 1984

[51] Int. Cl.[4] ..... B65D 41/00

[52] U.S. Cl. ..... 283/81; 283/94; 283/95; 283/114; 428/187; 428/195; 428/203; 428/204; 428/343; 428/916; 428/918; 428/40

[58] Field of Search ..... 428/195, 199, 200–204, 428/915, 916, 918, 187, 343; 220/359; 40/5; 283/81, 94, 95, 114

[56] References Cited

U.S. PATENT DOCUMENTS

| | | | |
|---|---|---|---|
| 1,167,566 | 1/1916 | Jenkins | 283/94 |
| 2,065,605 | 12/1936 | Moore | 283/94 |
| 2,300,787 | 11/1942 | Ingliss | 283/95 |
| 3,022,541 | 2/1962 | Passley et al. | 428/187 |
| 3,468,744 | 9/1969 | Reinhart | 428/913 |
| 3,734,808 | 4/1973 | Anderson | 428/187 |
| 3,854,581 | 12/1974 | Jones, Jr. | 428/915 |
| 3,923,198 | 12/1975 | Brochman | 220/359 |
| 3,935,960 | 2/1976 | Cornell | 283/95 |
| 3,974,311 | 8/1976 | Cherrin | 428/343 |
| 4,184,701 | 1/1980 | Franklin | 283/9 R |
| 4,209,126 | 6/1980 | Elias | 229/43 |
| 4,307,899 | 12/1981 | Hoppe | 283/114 |
| 4,343,851 | 8/1982 | Sheptak | 428/212 |
| 4,429,015 | 1/1984 | Sheptak | 428/201 |

*Primary Examiner*—Bruce H. Hess
*Assistant Examiner*—William M. Atkinson
*Attorney, Agent, or Firm*—Donald M. Sell; James A. Smith; John C. Barnes

[57] ABSTRACT

A tape product which bears a visible message which is changed when the tape is subjected to stress is adapted for use on containers and packages to indicate that the same container or package has been opened or the closure has been tampered with in an attempt to open the same. The message change is obtained by the tape becoming opaque to obliterate one message and provide a contrasting background for a different message.

20 Claims, 10 Drawing Figures

STRESS-OPACIFYING TAMPER INDICATING TAPE

BACKGROUND OF THE INVENTION

This invention relates to an improvement in tamper indicating tape for use with a closure and in one aspect to an improvement in a stress-opacifying tamper indicating tape which may be used to seal a package and which upon opening or attempted opening has a tape layer which becomes opaque obliterating one message which was clearly visible before the stressing of the tape and making visible clearly a second message upon undergoing stress.

DESCRIPTION OF THE PRIOR ART

The prior art discloses the use of various tape structures for use in forming closures for containers to seal the same and to tear or change color upon attempts to remove the tape. A tape product which changes color and appearance is disclosed in U.S.A. Letters Pat. No. 3,923,198 issued Dec. 2, 1975 and assigned to the assignee of this application. In this patent the tamper indicating tape was a portion of a tape closure which tape opacified when stressed providing a visual indication that the closure had been tampered with sufficiently to stress the sealing tape. When the tape backing opacified, the indicia printed on the exposed face of the tape became visible against the background of the opacified tape. The tape of this patent, however, because of light reflecting and diffusing effects of the backing also made the indicia visible but on a lesser scale before stressing of the backing. For this reason the tape lacked a very clear "on-off" indication of tampering with the tape. Thus, a clearer distinction from the exposed surface of the tape to indicate that the tape had undergone sufficient stress to opacify the same was desirable.

The indicating tape of the present invention provides the desired added ingredient to make the tape clearly an "on-off" construction.

The tape of the present invention affords in addition to the indication of the tampering an indication that the product is sealed or the tape closure is unbroken by providing indicia and a visual indication of such condition as well.

The present invention provides an improved tape structure which may be used in conjunction with an additional tape or as a self-supporting closure tape as hereinafter explained.

SUMMARY OF THE INVENTION

The present invention provides a stress-opacifying tamper indicating tape for use on closures. The tape comprises a stress opacifying translucent polymeric backing having an exposed surface on which is printed indicium by the use of a colored ink material which is preferably translucent and on the opposite surface of the backing is indicium of a contrasting color which opposite surface is also flood coated and colored in the background areas of the contrasting color indicium with a color substantially similar to that of said printed indicium on the exposed surface. The stress opacifying backing will become opaque when subjected to stress and produce a color which will enhance the printed indicium and obliterate the contrasting color indicium.

An adhesive layer may be placed adjacent the color coatings on the side of the backing opposite the exposed surface and a release liner may protect the adhesive.

The backing with the color indicia may also be laminated to a supporting film which provides strength for the stress opacifying backing layer. If the supporting film is transparent it may be laminated to the exposed surface of the backing and adhered to the exposed surface by a transparent adhesive. The supporting film could also be laminated to the surface opposite the exposed surface by the use of an adhesive applied to the coating defining the background color and an adhesive may be applied to the exposed surface of the supporting film to define a tamper indicating tape product.

The stress-opacifying tamper indicating tape may be used to provide tamper indication to a tape closure as defined in U.S.A. Letters Pat. No. 3,389,827 assigned to the assignee of this application as indicated in U.S. Pat. No. 3,923,198 referred to hereinabove.

The tape of the present invention may also be used as a sealing tape for bags or as a sealing tape for other structures which when unsealed provide an indication of prior use such as with doors or fire extinguishers.

BRIEF DESCRIPTION OF THE DRAWING

Present invention will be described in greater detail hereinafter with reference to the accompanying drawing wherein:

FIG. 8 is an illustrative view of the tape after the bag has been tampered with;

DETAILED DESCRIPTION OF THE INVENTION

Figure 1:
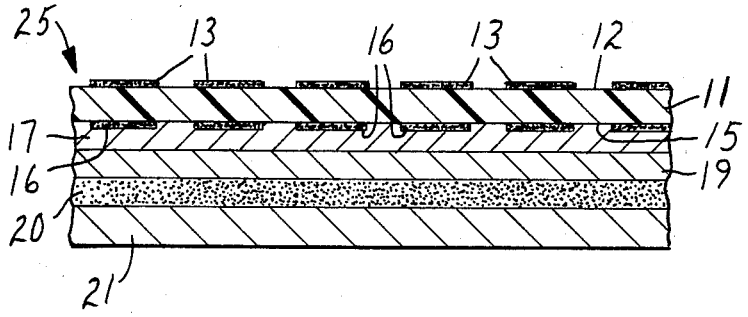
FIG. 1 is an enlarged illustrative cross-section of a tape according to the present invention.

Referring now to the accompanying drawing, the stress-opacifying tamper indicating tape of the present invention will be described together with several embodiments of the same wherein like reference numberals refer to like parts throughout. Referring to FIG. 1 there is shown a cross-section of a tape comprising a stress opacifying layer or backing 11 for the tape having an exposed surface 12 on which is printed indicium 13 formed by a translucent flexographic ink. On the surface 15 opposite the exposed surface 12 are printed indicium 16 formed of a suitable flexographic ink having a color contrasting with that of the indicia 13 and preferably being the dominant color such as a dark blue or black contrasted to, e.g. a red ink forming the message of indicium 13. The surface 15 is then flood coated with a first layer 17 and a second layer 19 of ink material which is substantially similar in color to the ink forming indicia 13 and which provides a background for the indicia 16. A layer of adhesive 20 is applied to the coated layer 19 to adhere the tape to a desired surface. A release liner 21 may be applied over the adhesive 20 to protect the same until the structure is to be applied. The tape described is generally designated by the numeral 25.

One example of the tape 25 is the use of a 1 to 10 mil (0.025 to 0.25 mm) thick film backing of transparent or translucent stress-opacifiable material 11 such as unplasticized polyvinyl chloride or other suitable films including polyvinyl chloride/polyvinyl acetate, isotactic polypropylene/butyl rubber blends and polystyrene/-butadiene. One surface of this backing is printed with the colored message "opened" or similarly descriptive word indicating the closure system has been tampered with. The opposite surface of the film contains another printed message but of a much bolder color than the first printed message so that it is visible through the transparent or translucent backing and overpowers the visible first printed image so that the first message is unreadable because of the two images 13 and 16 being registered or superimposed on opposite surfaces of the backing 11. The colored message of indicia 16 on the opposite surface states "sealed" or some other word which describes that the material has not been tampered with. Behind the second message or indicia 16 is a double layer of colored ink of the same color as the indicia 13. This provides a background for the second printed message highlighting it and also has the added advantage of enhancing the obscuration of the printed indicia 13.

A specific example is a stress opacifiable resin of the type made of polystyrene/butadiene (commercially available from Dow Chemical Company as "Styron" (R) 489 natural molding polystyrene) extruded as a 4 mil (0.1 mm) film. This film is then flexographically printed on one surface with the message "opened" in a red ink. The ink suitable for use in this invention is "Pliolox" Watchtung Red used to form the indicium 13. The opposite surface of the opacifiable film is printed with a flexographically applied message "sealed" in a dark blue ink such as "Pliolox" Cyan Blue. These inks are available from Inmont Corporation having an office at 1301 Bryant Avenue North, Minneapolis, Minn. The surface opposite the exposed surface is then also flood coated with the red ink to provide two layers of red color of the same type as used for the indicium 13. The adhesive 20 may be applied to the coated opposite surface. A suitable adhesive is one comprising 80 parts "Solprene 1205" available from Phillips Petroleum Company, Bartlesville, OK; 20 parts "Kraton 1101" available from Shell Oil Company, Houston, TX; 85 parts "Super Sta Tac 100" available from Reichold Chemicals, Inc., White Plains, N.Y.; 2 parts "Antioxidant 330" available from Ethyl Corporation, Richmond, VA; and 211 parts toluene. The components are first dissolved in the toluene to 40–50% solids and knife coated on the release liner, dried in the oven at 150° F. (65.5° Celsius) for 10 minutes. The solvent free adhesive had a coating weight of 6 grains per 24 square inches (0.0025 grams per square centimeter). The adhesive formulation is pressure sensitive and is laminated to the "Pliolox" flexographic ink coated stress-opacifying film. The flexographic ink is a vinyl acrylic ink. The release liner 21 provides a tape product which may be wound in roll form without providing a release coating to the exposed surface of the opacifying layer 11 having the printed indicia 13.

Figure 4:
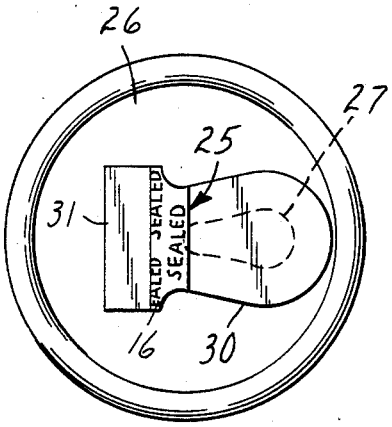
FIG. 4 is a plan view of a can end incorporating the tape of the present invention.
Figure 5:
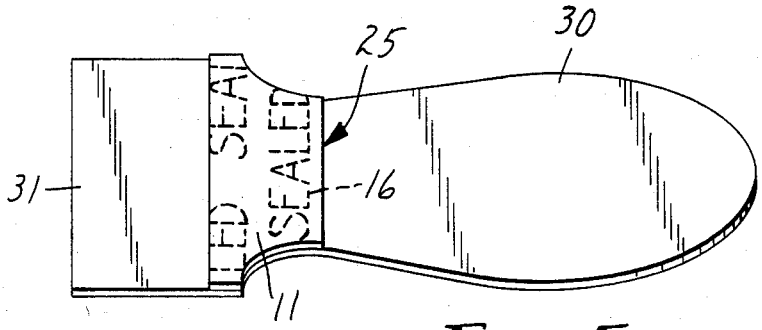
FIG. 5 is an enlarged view of a closure tape utilizing the tape of the present invention.

The tape 25 is suitable for use as the tamper indicating tape on a tape closure for a can end as generally illustrated in FIG. 4. FIG. 4 depicts a can lid 26 having an aperture 27 covered and sealed by a closure tape 30, with the transparent stress opacifiable indicating tape 25 being firmly adhered to the upper surface of the closure tape 30. As indicated in FIG. 5 the liner 21 was removed from the tape 25 and a short section of the tape 25 was placed on the tape for forming the closure tape 30 and then the closure tape 30 was die cut in the shape depicted. The tamper indicating tape 25 has the printed message "sealed" formed by the indicium 16 clearly visible on the surface showing that the opacifiable tape is in its unstressed transparent or translucent condition.

Figure 6:
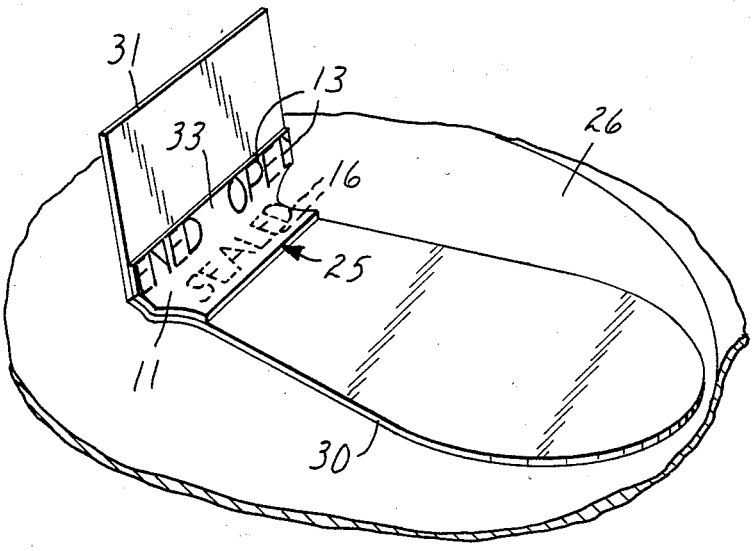
FIG. 6 is an illustrative view of the tape of the present invention when the closure tape has been subjected to stress sufficient to opacify the tamper indicating tape.

FIG. 6 shows the tab end 31 of the tape 30 being raised or peeled from the can end 26. As the tamper indicating tape 25 is creased, rolled or stretched the tape opacifies in the stretched area as indicated at 33 in FIG. 6 causing the indicia 16 to be obliterated as layer 11 becomes opaque under the stresses of creasing and peeling and the indicia 13 showing the word "opened" is then clearly visible against the background formed by the whitening of the opacifying layer 11.

Figure 2:
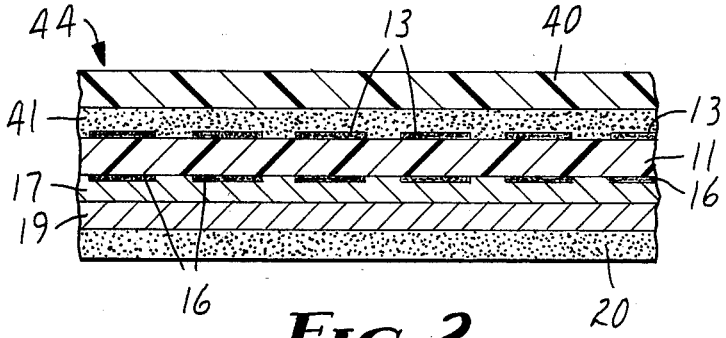
FIG. 2 is an illustrative cross-sectional view of a second embodiment of a tape according to the present invention.

In a second embodiment the tamper indicating tape generally designated 44 includes an additional support film as illustrated in FIG. 2. The purpose of the support film is to increase the uses of the tape as the support film will give the tape added strength changing the force required to opacify the tape. The opacifying layer 11 with the indicium 13 and 16 printed on opposite surfaces, the flood coat layers 17 and 19 appearing on the surface opposite the exposed surface, and the layer of adhesive 20 applied to the surface of the ink layer 19 remain the same. In this embodiment a film 40 is laminated by an adhesive 41 to the exposed surface of the tape construction. This film 40 is a transparent film adhered to the exposed surface of the opacifying layer by a transparent adhesive 41.

Examples of the film are a 1.2 mil (0.03 mm) thick biaxially oriented polypropylene, or a 1.0 mil (0.025 mm) biaxially oriented polyester film, or a 1.0 mil (0.025 mm) polyethylene film, or a 5.5 mil (0.14 mm) polycarbonate film.

Each of the above identified types of film samples were laminated to tape 25 with a 4 mil (0.1 mm) backing and cut to one inch (25.4 mm) in width and put in an Instron Model 1130 tensile tester manufactured by Instron Corporation of Canton, Mass. to test the force required to opacify the tamper indicating tape to the point where the message indicating tampering had occurred was readable. In this machine the jaw separation or length of tape was two inches (51 mm) and the jaw separation rate was set at two inches per minute (51 mm per minute). The values received show the opacification occurred at about 5% elongation in all cases. This is indicated in table I below.

TABLE I

| Tape | Force to Opacify at 5% Elongation (Newtons/100 mm width) |
|---|---|
| Tape 25 | 150 |
| Tape 25 + 0.03 mm polypropylene | 259 |

TABLE I-continued

| Tape | Force to Opacify at 5% Elongation (Newtons/100 mm width) |
|---|---|
| Tape 25 + 0.025 mm polyester | 420 |
| Tape 25 + 0.025 mm polyethylene | 170 |
| Tape 25 + 0.14 mm polycarbonate | 923 |

Figure 3:
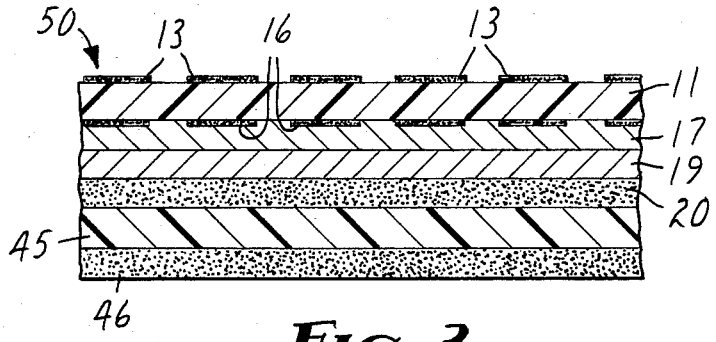
FIG. 3 is an illustrative cross-sectional view of a further embodiment of a tape constructed according to the present invention.

In the example of the tape illustrated in FIG. 3 the opacifying layer 11, with the printed indicia 13 and the contrasting indicia 16, together with the flood coated layers of ink material 17 and 19, and the adhesive layer 20 remain but the adhesive 20 bonds to the tape a film layer 45 which film 45 is coated with a further pressure sensitive adhesive 46. In this embodiment of a tape construction generally designated by the numeral 50 the film 45 may be an opaque polycarbonate, or a polypropylene, polyester or polyethylene film as identified above but the same need not be transparent or translucent in the tape construction generally designated 44.

Figure 7:
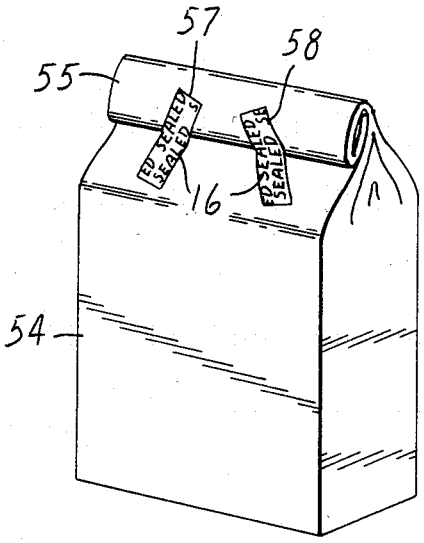
FIG. 7 is an illustrative perspective view of the tape of the present invention used as a closure on a bag.
Figure 9:
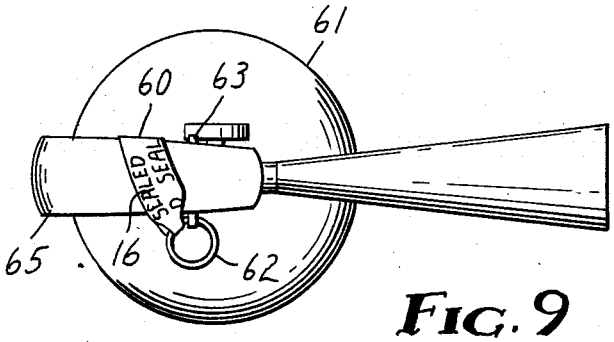
FIG. 9 is a plan view of a strip of tape according to the present invention for sealing the protective pin in a fire extinguisher.
Figure 10:
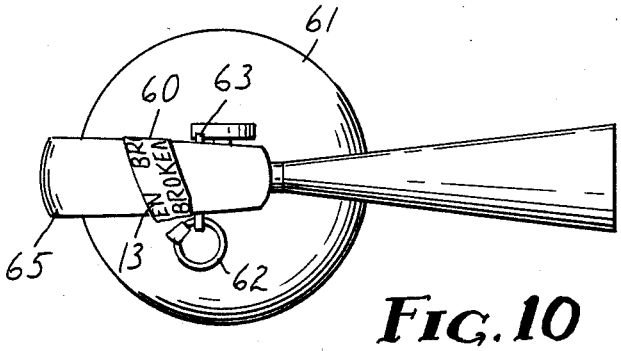
FIG. 10 is a view of the fire extinguisher of FIG. 9 when the tape has been stressed sufficiently to permit the pin to be removed from the handle of the extinguisher.

Tape of the type designated by the reference numeral 44 or 50 may be utilized to seal a container such as illustrated in FIG. 7 or to seal a closure member which would indicate the use of the product such as illustrated in FIG. 9.

Figure 8:
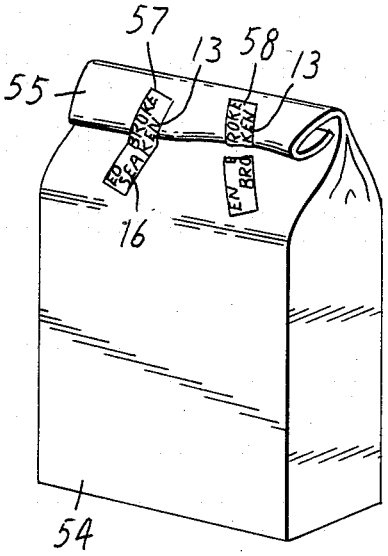

In FIG. 7 a bag 54 has a product sealed therein and the top of the bag is gathered to form an upper flag 55 which is then folded or rolled and strips 57 and 58 of stress-opacifying tamper indicating tape according to tape 44 or 50 are applied to the folded end 55 and to the body of the bag 54. When one attempts to unroll the end of the bag as illustrated in FIG. 8 the tape is stretched and when pulled by an amount equal to five percent of the elongation of the tape, or to the point of breakage of the tape as illustrated for the tape strip 58, the indicia 16 reciting the word "sealed" has been obliterated and the indicia 13 becomes visibly apparent displaying the word "broken". Also for the tape 57 it can be seen that the tape has been slightly stretched so that the indicia 16 becomes partially obliterated and portions of the indicia 13 become apparent at the exposed surface of the tape strip 57.

In FIG. 9 the tape strip 60 is applied over the handle of a fire extinguisher 61 to seal the pull ring 62 on the end of the release pin 63 to the handle 65. In the event that one needs to use the fire extinguisher, the ring 62 can be grasped to pull the pin 63 from its placement through the handle 65 thus releasing the handle 65 to permit the use of the extinguisher. Pulling the ring causes the strip of tape 60 to be stretched and broken and the tape layer 11 then opacifies such that the indicia 16 as seen in FIG. 9 is obliterated and the indicia 13 becomes clearly visible.

A further example of a tape construction is a tape having the opacifiable layer 11 with the printed indicium 13 and 16 together with the coated layers of ink material 17 and 19 but the film 40 or 45 is a stretched film which is heat shrinkable permitting the resulting tape product 44 to be applied as a band around the neck and cap of a bottle or food tub and to be shrunk down on to the bottle and cap or food tub and cover to secure the same together and form a tamper indicating seal for the bottle or food tub. A suitable material for layer 40 or 45 is Tape No. 6887 available from 3M, Saint Paul, MN which is an adhesive tape made from unplasticized polyvinyl chloride film stretched in the machine direction. A peeling or attempted peeling of the laminated tape causes the layer 11 to readily opacify.

The adhesive used on the tapes 25, 44 or 50 to apply the tape to the package or closure may be a thermosetting, thermoplastic or pressure sensitive adhesive. The adhesive must adhere the tape to the substrate with sufficient integrity such that the composite tape cannot be removed without causing an elongation or flexure of the tape such that the opacifying layer 11 is stressed to opacify and change color to obliterate the message defined by the indicium 16 and present clearly the translucent indicium 13. In the unstressed mode the tamper-indicating tape will have the message "sealed" showing through the transparent stress opacificable layer 11. When stressed either by stretching or bending at a sharp angle, the opacifying layer becomes opaque enough to effectively block the "sealed" message from appearing and obliterate also the background flood coated ink material 17 from being visible, revealing only the message presented on the exposed surface by the indicium 13 to display a message such as "opened" or "broken" or similar message.

While the present invention has been fully described with respect to several embodiments it is clear from this disclosure that the composite of the tamper indicating tape and a film can provide a tape which will meet many specific applications as the film 40 or the film 45 used with the tape may be tailored to make the tamper indicating tape as strong as required and/or as tough as required as with a polycarbonate film to suit the particular application before it becomes either stretched or broken to opacify the tape giving the indication that there has been force applied to the tape.

The invention claimed is defined in the appended claims:

1. A stress-opacifying tamper indicating tape for use on closures comprising:

a stress-opacifying translucent polymeric backing having an exposed surface, printed indicium on said exposed surface of a translucent colored ink material, contrasting indicium on the opposite surface of said backing of contrasting colored ink material and a coating in the background area of said contrasting indicium on said opposite surface, said background coating being of a color substantially similar to the color of said printed indicium, whereby said contrasting indicium of contrasting color is visible from said exposed side of said backing until said backing is subjected to stress sufficient to opacify said backing and obliterate said contrasting indicium and said background coating to enhance the visibility of said printed indicium.

2. A tape according to claim 1 wherein said background coating is defined by a layer of said translucent colored ink material on said opposite surface and on said contrasting indicium.

3. A tape according to claim 1 wherein a layer of adhesive is coated on said background coating of material defining said background area and said contrasting indicium.

4. A tape according to claim 1 wherein a layer of adhesive is applied to said background area and said contrasting indicium and a liner is applied to said adhesive layer.

5. A tape according to claim 1 wherein the printed indicium and the contrasting indicium are in register on opposite sides of the backing.

6. A tape according to claim 1 wherein said backing is a polystyrene/butadiene.

7. A tape according to claim 6 wherein said translucent ink material is a vinyl acrylic flexographic ink.

8. A tape according to claim 3 wherein a supporting film layer is adhered to said adhesive layer and has a further layer of adhesive secured to said supporting film layer on the surface of said supporting film opposite said first mentioned adhesive.

9. A tape according to claim 8 wherein said film layer is a polycarbonate film.

10. A tape according to claim 8 wherein said film layer is a polypropylene film.

11. A tape according to claim 8 wherein said film layer is a polyester film.

12. A tape according to claim 8 wherein said film layer is a polyethylene film.

13. A tape according to claim 1 wherein a supporting film is laminated to said backing adjacent one of said exposed surface and said opposite surface and adhered thereto by a layer of adhesive.

14. A tape according to claim 13 wherein said supporting film is a translucent film secured by a layer of translucent adhesive to the exposed surface of said backing.

15. A tape according to claim 13 wherein said supporting film is a biaxially oriented polypropylene.

16. A tape according to claim 13 wherein said supporting film is polyethylene.

17. A tape according to claim 13 wherein said film is biaxially oriented polyester film.

18. A tape according to claim 13 wherein said film is polycarbonate.

19. A tape according to claim 13 wherein said supporting film is a heat shrinkable film.

20. A stress-opacifying tamper indicating tape comprising:

a stress-opacifying translucent polymeric backing having an exposed surface, printed indicium on said exposed surface of a translucent colored ink material, contrasting indicium adhered on the opposite surface of said backing in register with said printed indicium or said exposed face, said contrasting indicium being a darker color ink material than said translucent colored ink material, and a coating in the background area of said contrasting indicium on said opposite surface, said background coating being of a color substantially similar to the color of said printed indicium, whereby said contrasting indicium of contrasting color is visible from said exposed side of said backing until said backing is subjected to stress sufficient to opacify said backing and obliterate said contrasting indicium and said background coating to enhance the visibility of said printed indicium.

* * * * *